US008234996B2

(12) United States Patent
Smith

(10) Patent No.: US 8,234,996 B2
(45) Date of Patent: Aug. 7, 2012

(54) APPARATUS AND METHOD FOR A SORT STATION COMMUNICATION SYSTEM

(75) Inventor: Steven L. Smith, Buford, GA (US)

(73) Assignee: United Parcel Service of America, Inc., Atlanta, GA (US)

( * ) Notice: Subject to any disclaimer, the term of this patent is extended or adjusted under 35 U.S.C. 154(b) by 860 days.

(21) Appl. No.: 12/339,835

(22) Filed: Dec. 19, 2008

(65) Prior Publication Data

US 2010/0155311 A1 Jun. 24, 2010

(51) Int. Cl.
*G09F 9/00* (2006.01)

(52) U.S. Cl. ..... 116/307; 116/200; 116/1

(58) Field of Classification Search ..... 116/306–307, 116/1, 200, 201; 209/684, 702
See application file for complete search history.

(56) References Cited

U.S. PATENT DOCUMENTS

| | | | | | |
|---|---|---|---|---|---|
| 824,222 | A * | 6/1906 | Warren | 439/478 |
| 3,143,286 | A * | 8/1964 | Edge, Sr. | 232/35 |
| 3,926,143 | A * | 12/1975 | Hothan | 116/228 |
| 3,999,440 | A * | 12/1976 | Kain | 73/431 |
| 4,026,239 | A * | 5/1977 | Andvig | 116/200 |
| 4,412,447 | A * | 11/1983 | McMahan | 73/73 |
| 5,016,753 | A * | 5/1991 | Henderson | 206/459.1 |
| 5,230,296 | A * | 7/1993 | Giltz et al. | 116/28 R |
| 5,297,500 | A * | 3/1994 | Wilson | 116/28 R |
| 5,315,953 | A * | 5/1994 | Mullarkey, Jr. | 116/28 R |
| 5,329,874 | A * | 7/1994 | Posey | 116/222 |
| 5,535,547 | A * | 7/1996 | Brunengo | 47/40.5 |
| 5,634,856 | A * | 6/1997 | Rainey | 473/234 |
| 5,881,890 | A | 3/1999 | Wiley | |
| 5,998,751 | A | 12/1999 | Brunelle | |
| 6,213,047 | B1 * | 4/2001 | Means et al. | 116/28 R |
| 6,279,243 | B1 * | 8/2001 | Tranå | 33/512 |
| 6,652,182 | B1 * | 11/2003 | Ellefson | 404/9 |
| 6,778,086 | B2 * | 8/2004 | Morrone et al. | 340/546 |
| 6,878,896 | B2 | 4/2005 | Braginsky et al. | |
| 6,969,257 | B2 * | 11/2005 | Groen | 434/252 |
| 7,164,352 | B2 * | 1/2007 | Nelson | 340/472 |
| 7,481,598 | B2 * | 1/2009 | Jankovsky | 404/6 |
| 7,752,991 | B2 * | 7/2010 | Graves | 116/28 R |
| D640,905 | S * | 7/2011 | Shaljian | D8/1 |

* cited by examiner

*Primary Examiner* — Peter Macchiarolo
*Assistant Examiner* — Tania Courson
(74) *Attorney, Agent, or Firm* — Alston & Bird LLP

(57) ABSTRACT

The sort station system includes at least one outer support member and an elongated inner member. The at least one outer support member defines a channel along a first longitudinal axis thereof, and the elongated inner member is slideably disposed within the at least one outer support member such that: (A) a first status is indicated by the at least one outer support member being disposed at a first position relative to an end of the channel and (B) a second status is indicated by the end of the elongated inner member being disposed at a second position relative to the end of the channel. The first position and the second position are spaced apart axially from each other.

34 Claims, 7 Drawing Sheets

APPARATUS AND METHOD FOR A SORT STATION COMMUNICATION SYSTEM

BACKGROUND OF THE INVENTION

Sort stations for sorting items have been available for many years. Such stations are useful in, for example, sorting packages into sort bins based on the destination of the packages. In general, a loader sorts packages into the sort bins on one side of the sort station, and, when a sort bin needs to be unloaded, the loader communicates to a bagger on the other side of the sort station to unload the bin. Upon receiving the communication from the loader to unload the sort bin, the bagger unloads the packages from the sort bin into one or more bags. After unloading the bin, the bagger communicates to the loader that the bin is empty and ready to be loaded again. This communication between the loader and the bagger is paramount for efficient operation of the sort station. Because the loader and bagger usually cannot see each other, they may rely on verbal communication to indicate when a particular sort bin needs to be unloaded or when a particular sort bin is empty. However, verbal communication is typically ineffective because sort station environments are usually noisy. Other systems may employ a communication panel located near the sort station that displays lights to indicate the status of each bin and receives input from the operators regarding the status. However, the operators (i.e., the loader and the bagger) must check the communication panel for the status of a bin (e.g., "full" or "bagged") and must move away from the sort bin and toward the communication panel to provide input regarding the status of the sort bin, which increases the operators' processing times. In addition, the components of the electronic visual communication systems are expensive and require regular maintenance.

Thus, there is a need for a simple, reliable, and cost-effective communication system for sort stations.

BRIEF SUMMARY OF VARIOUS EMBODIMENTS OF THE INVENTION

In one embodiment of the present invention, a sort station communication system includes at least one outer support member and an elongated inner member. The at least one outer support member defines a channel along a first longitudinal axis of the at least one outer support member. The channel of the at least one outer support member has an inner width. The elongated inner member has an outer width and a second longitudinal axis. The outer width of the elongated inner member is smaller than the inner width of the at least one outer support member. The elongated inner member is slideably disposed within the at least one outer support member such that: (A) a first status is indicated by the end of the elongated inner member being disposed at a first position relative to an end of the channel and (B) a second status is indicated by the end of the elongated inner member being disposed at a second position relative to the end of the channel. The first position and the second position are spaced apart axially from each other.

In various embodiments, the at least one outer support member consists of an elongated outer support member, and in a particular embodiment, the at least one outer support member is a hollow outer tube. In other embodiments, the at least one outer support member includes two or more outer support members that are spaced apart from each other along the first longitudinal axis.

In addition, in various embodiments, the ends of the elongated inner member each include a plug. The plug has an outer surface that is radially spaced apart from the second longitudinal axis, and the outer surface is biased in a radially outward direction so as to contact the channel of the at least one outer support member and prevent unintentional movement of the elongated inner member relative to the at least one outer support member.

In various embodiments, a sort station system is provided that includes the at least one outer support member and elongated inner member described above and a sort station. The sort station includes at least one sort bin that extends from a first side of the sort station to a second side of the sort station, and the first side is spaced apart from and opposite to the second side. The at least one outer support member is disposed adjacent to the at least one sort bin, and the first longitudinal axis of the at least one outer support member extends from the first side of the sort station to the second side of the sort station.

Various embodiments provide a method of indicating at least a first status and a second status. The method includes the steps of: (1) providing at least one outer support member that defines a channel along a first longitudinal axis of the at least one outer support member, the channel of the at least one outer support member having an inner width; (2) providing an elongated inner member having an outer width and a second longitudinal axis, the outer width of the elongated inner member being smaller than the inner width of the at least one outer support member, wherein the elongated inner member is slideably disposed within the channel of the at least one outer support member; (3) slideably moving a first end of the elongated inner member in a first direction along the second longitudinal axis to indicate a first status, the first end of the elongated inner member being moved to a first position relative to a first end of the at least one outer support member; and (4) slideably moving a second end of the elongated inner member in a second direction along the second longitudinal axis to indicate a second status, the second end of the elongated inner member being moved to a second position relative to a second end of the channel of the at least one outer support member.

BRIEF DESCRIPTION OF DRAWINGS

Figure 1:
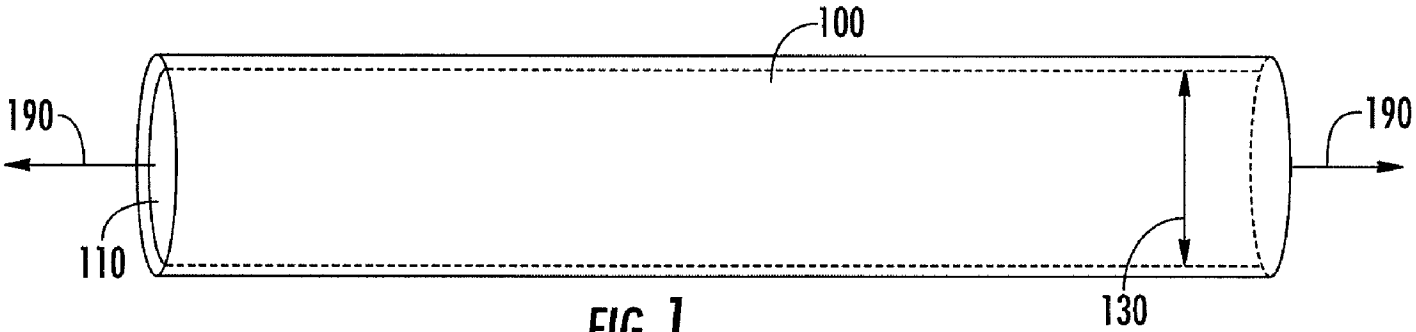

Having thus described the invention in general terms, reference will now be made to the accompanying drawings, which are not necessarily drawn to scale, and wherein:

FIG. 1 is a side view of an outer support member according to one embodiment of the invention.

Figure 2:
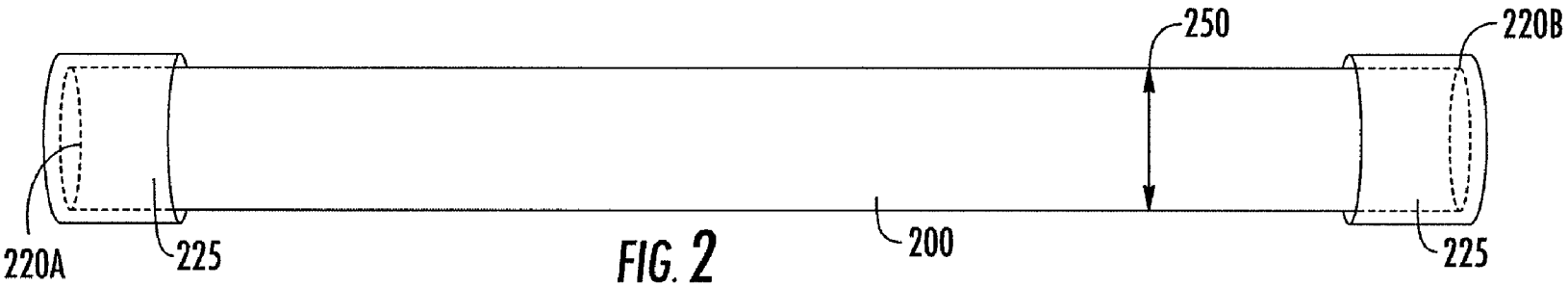

FIG. 2 is a side view of an elongated inner member according to one embodiment of the invention.

Figure 3:
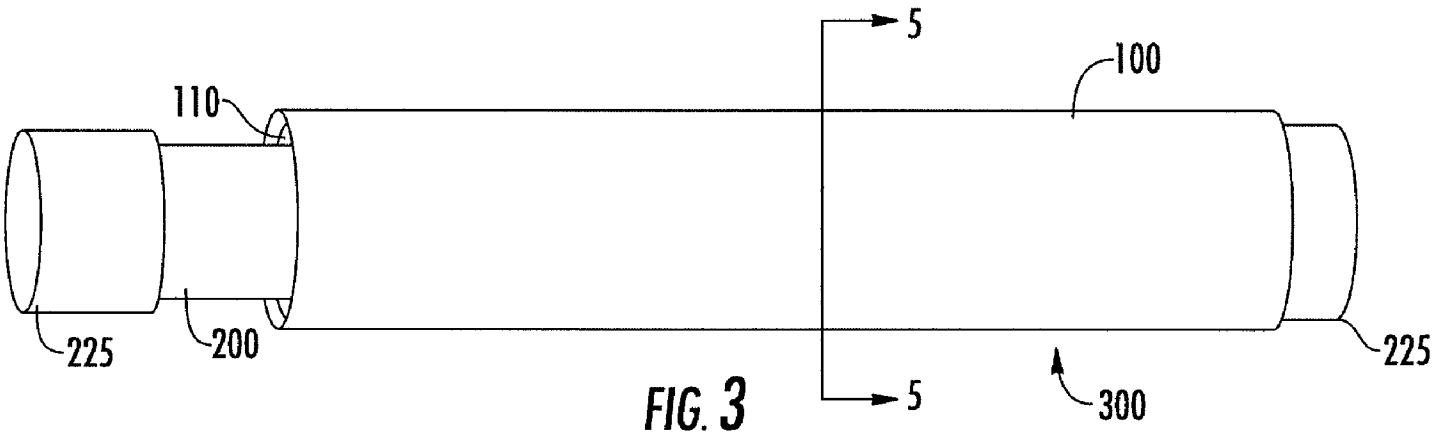

FIG. 3 is a side view of the elongated inner member shown in FIG. 2 slideably disposed within the outer support member shown in FIG. 1.

Figure 4:
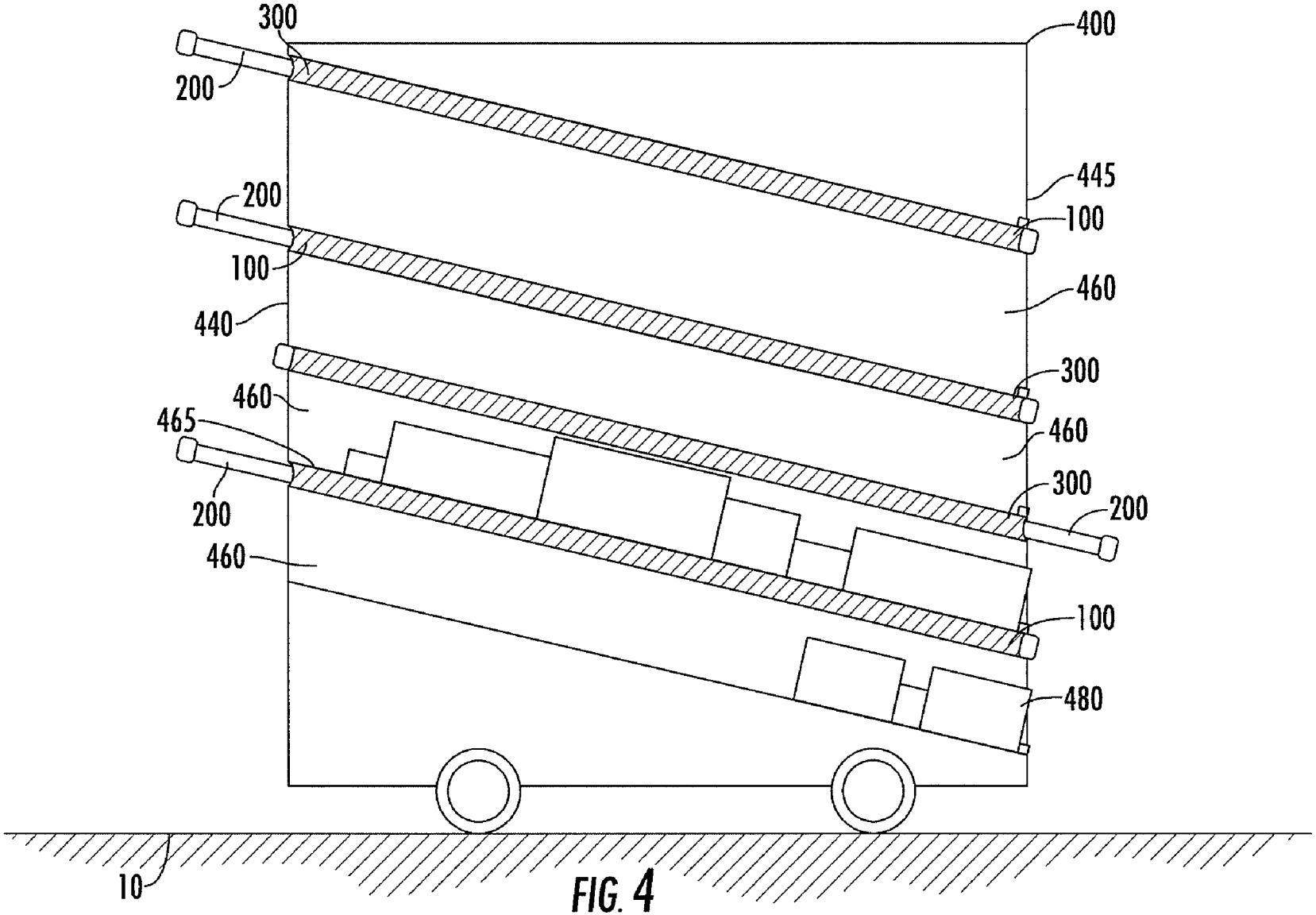

FIG. 4 is a cross-sectional view of the sort station according to one embodiment of the invention.

Figure 5:
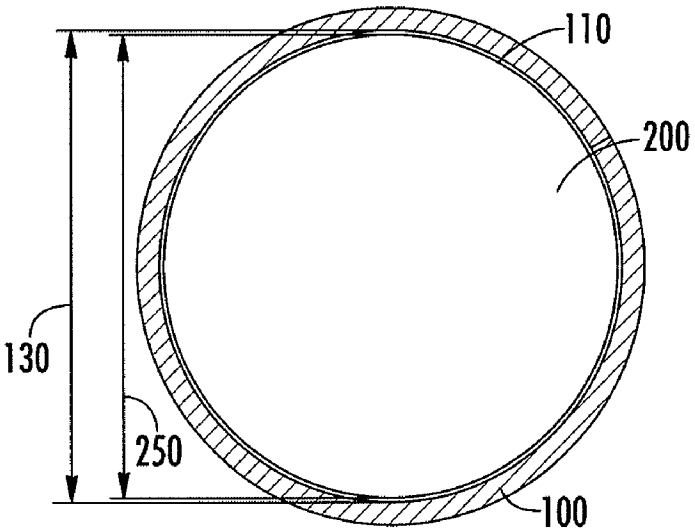

FIG. 5 is a cross-sectional view through the 5-5 line of the elongated inner member and the outer support member shown in FIG. 3.

Figure 6:
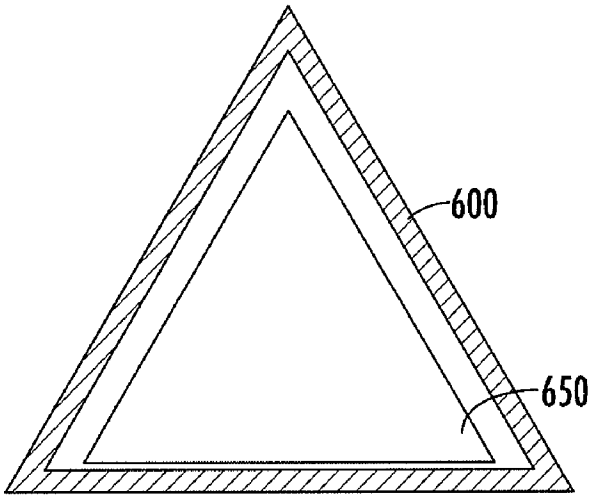

FIG. 6 is an end view of a substantially triangular elongated inner member and outer support member according to an alternative embodiment of the invention.

Figure 7:
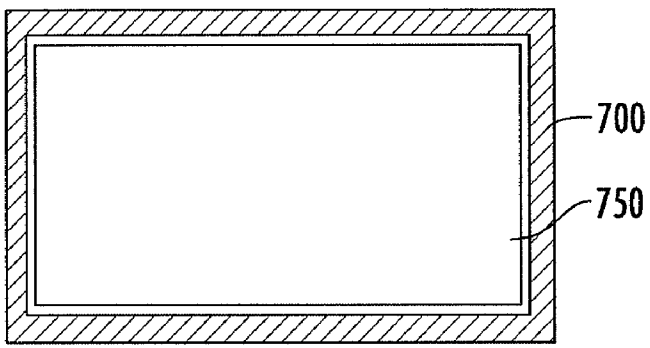

FIG. 7 is an end view of a substantially rectangular cross-section of the elongated inner member and outer support member according to another embodiment of the invention.

Figure 8:
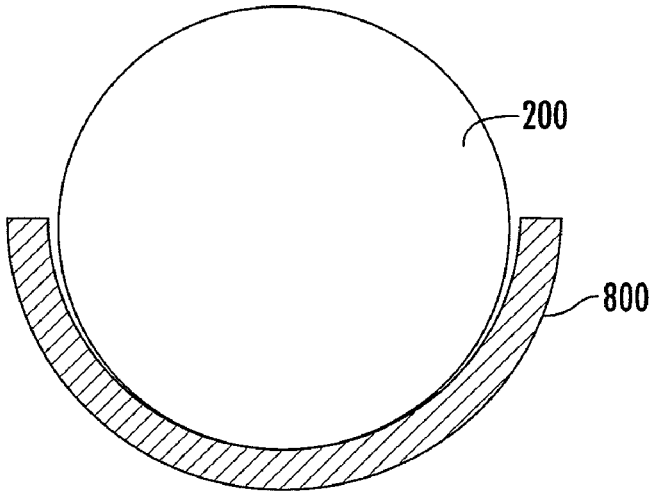

FIG. 8 is an end view of a substantially U-shaped outer support member according to yet another embodiment of the invention.

Figure 9:
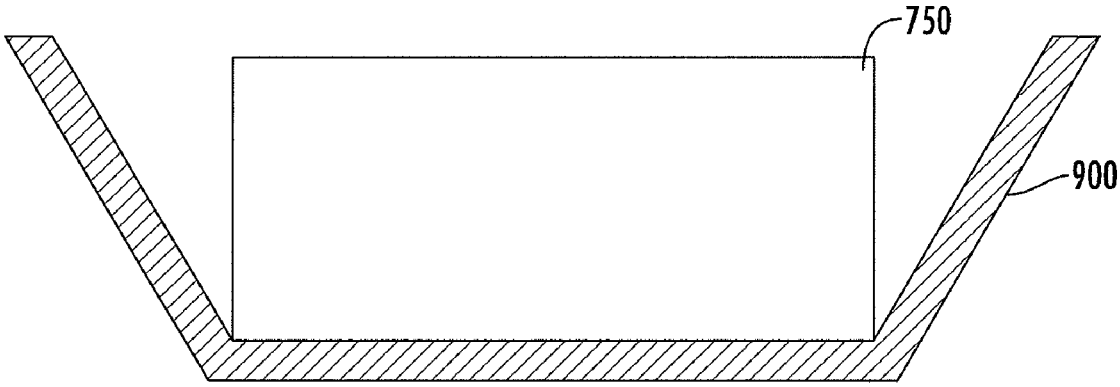

FIG. 9 is an end view of a partially substantially trapezoidal-shaped outer support member according to yet another embodiment of the invention.

Figure 10:
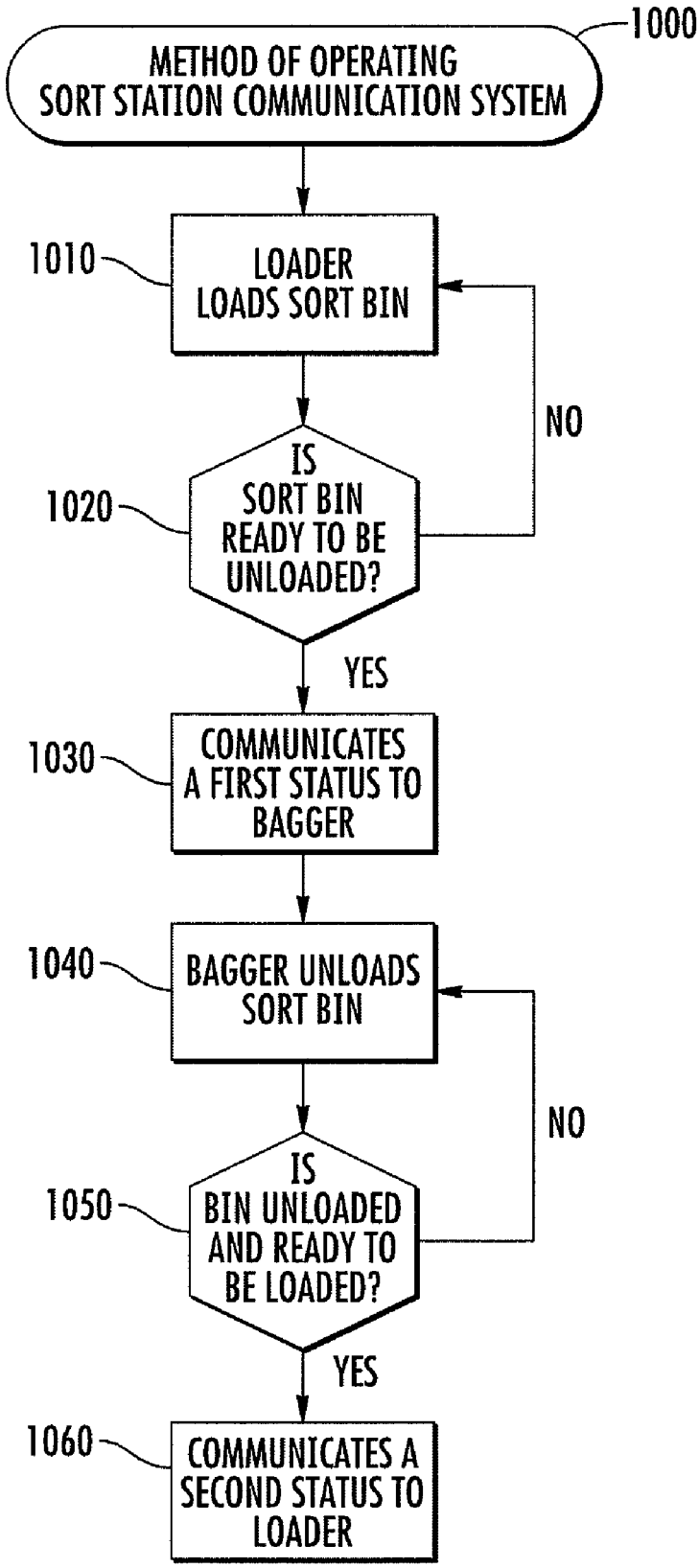

FIG. 10 illustrates a method of operating the sort station communication system.

Figure 11:
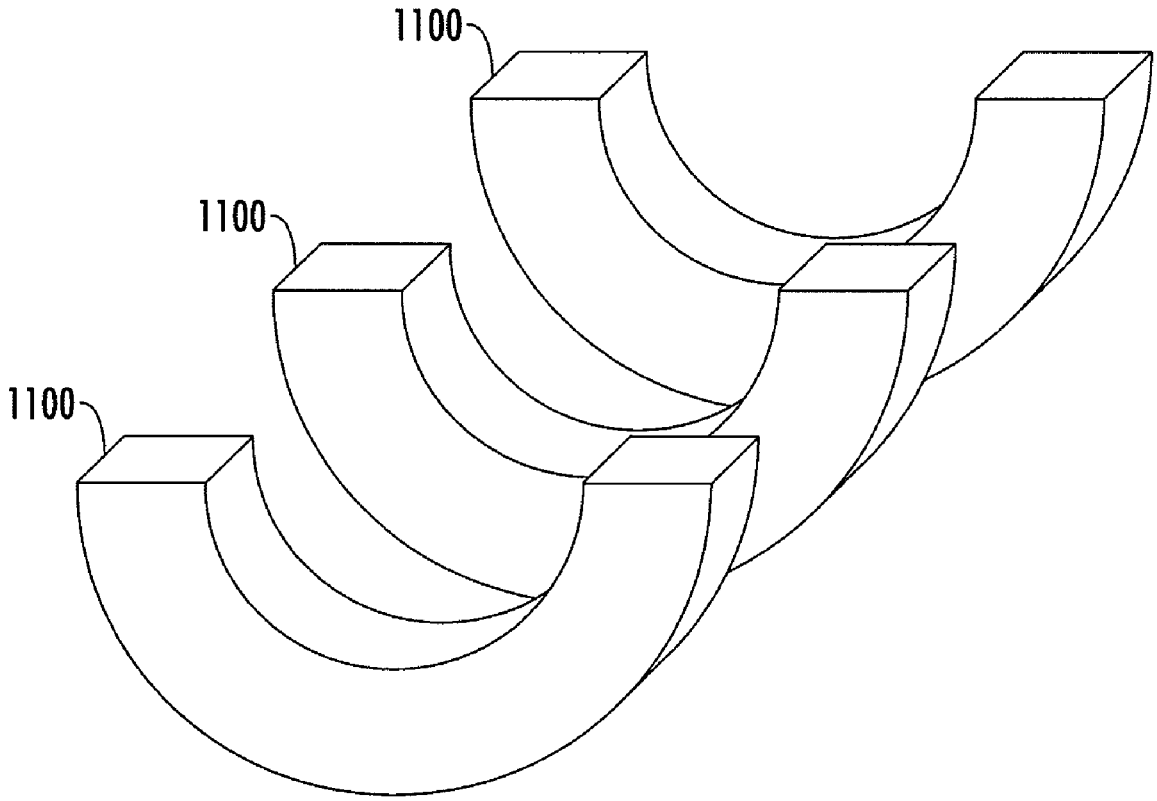

FIG. 11 illustrates a perspective view of a plurality of outer support members according to an alternate embodiment.

Figure 12:
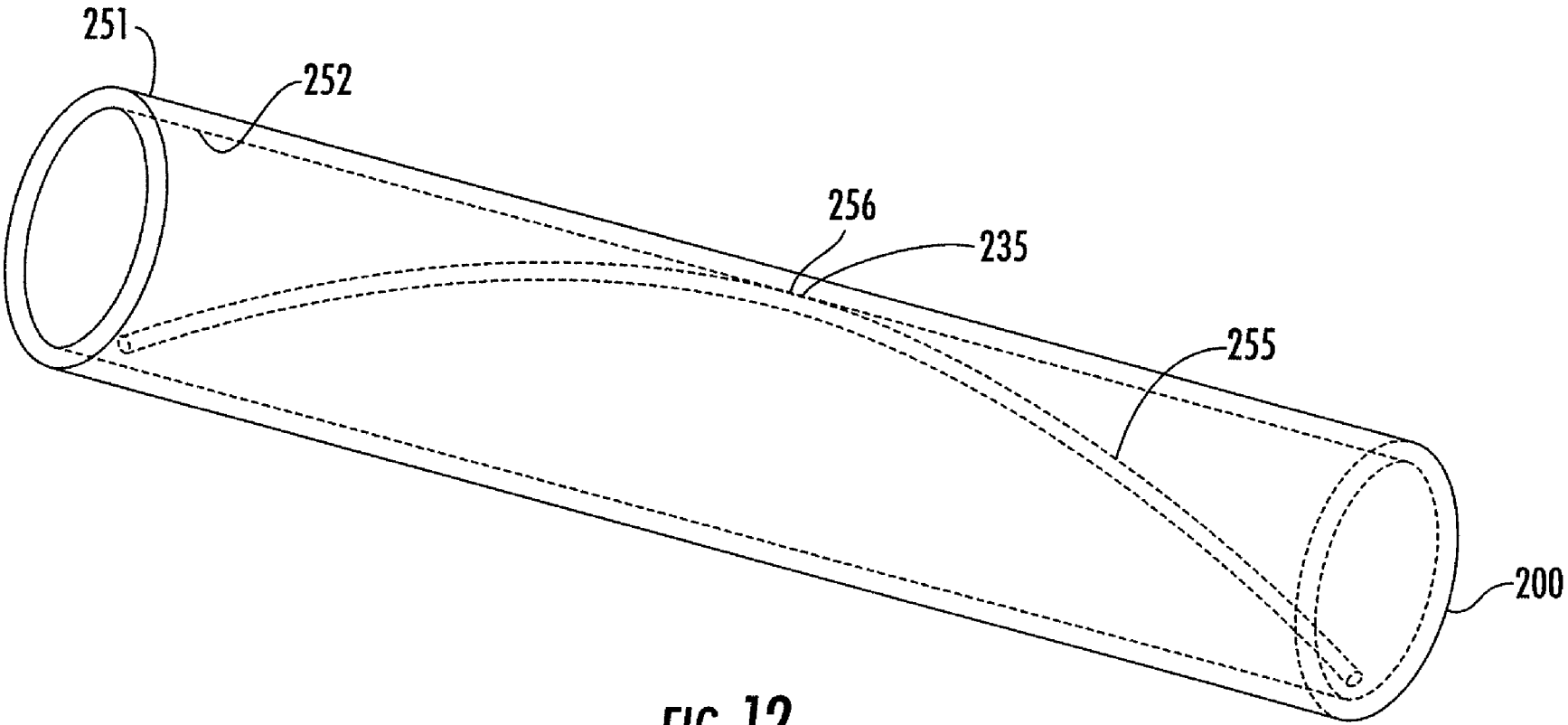

FIG. 12 illustrates a perspective view of an elongated inner member according to an alternate embodiment.

DETAILED DESCRIPTION OF VARIOUS EMBODIMENTS OF THE INVENTION

Various embodiments of the invention are described more fully hereinafter with reference to the accompanying drawings, in which some, but not all embodiments of the invention are shown in the figures. Indeed, these inventions may be embodied in many different forms and should not be construed as limited to the embodiments set forth herein; rather, these embodiments are provided so that this disclosure will satisfy applicable legal requirements.

According to various embodiments of the invention, a sort station system is used to sort packages based on one or more categories, such as shipping destination, addressee, and/or size. For example, FIG. 4 illustrates one embodiment of a sort station system 400. In this embodiment, the sort station system 400 includes a plurality of sort bins 460 that extend from a first side 440 of the sort station system 400 to a second side 445 of the sort station system 400, wherein the first side 440 is opposite and spaced apart from the second side 445. Operationally, in this embodiment, a loader on the first side 440 sorts and loads one or more packages into the sort bins 460, and a bagger on the second side 445 empties the packages in each bin 460 into a bag or other suitable container when the sort bin 460 is full or otherwise needs to be emptied.

To communicate that a particular sort bin 460 is ready for unloading, the loader moves an elongated inner member 200 disposed adjacent the particular sort bin 460 axially in a first direction. Similarly, the bagger communicates to the loader that the sort bin 460 is ready for loading by moving the elongated inner member 200 axially in a second direction, wherein the second direction is opposite the first direction. Various embodiments of the sort station system 400 are described below.

Sort Station System

The embodiment of the sort station system 400 shown in FIG. 4 includes a plurality of sort bins 460. In this embodiment, each sort bin 460 defines a channel that extends from the first side 440 of the sort station system 400 to the second side 445 of the sort station system 400. Each sort bin 460 includes a floor 465 on which the packages are placed. In various embodiments, the floor 465 may include rollers or a conveyor belt to assist in moving the packages from the first side 440 of the sort station system 400 to the second side 445. In various other embodiments, to assist in moving the packages, the floor 465 may include a surface made with a material having a low coefficient of friction, such as plastic, wood, or metal.

Alternatively or in addition to, the floor 465 of each sort bin 460 is slanted downwardly from the first side 440 to the second side 445 at an angle greater than 0° with respect to the support surface 10 on which the sort station system 400 rests. The slanted floors 465 allow the packages 480 placed within the bins 460 to slide down the floor 465 of the sort bin 460 from the first side 440 to the second side 445. However, in various other embodiments (not shown), the packages 480 may be placed in the second side 445 and forced upwardly toward the first side 440, the floor 465 may be slanted downwardly from the second side 445 to the first side 440, or the floor 465 of each sort bin 440 may be substantially parallel with the support surface 10 on which the sort station system 400 rests.

Communication System

The sort station system 400 further includes a communication system 300 that allows (a) the loader to communicate to the bagger when each sort bin 460 is full or otherwise needs unloading and (b) the bagger to communicate to the loader when each sort bin 460 is ready for loading. According to various embodiments, the communication system 300 includes at least one outer support member that defines a channel along a first longitudinal axis and an elongated inner member that has a second longitudinal axis. The elongated inner member is slideably disposed within the channel of the at least one outer support member.

Outer Support Member

As shown in the embodiments of FIGS. 1, 3, 4, and 5, the at least one outer support member is an elongated hollow outer tube 100. The hollow outer tube 100 defines a channel 110 therethrough having a substantially circular cross-section in a plane that is substantially perpendicular to a longitudinal axis 190 of the tube 100. The channel 110 has an inner diameter 130 and a length, and the length of the hollow outer tube 100 extends between the first side 440 and the second side 445 of the sort station system 400. In the embodiment shown in FIG. 4, the sort station system 400 defines chambers 470 adjacent each sort bin 460 in which hollow outer tubes are 100 disposed.

According to one embodiment of the invention, the hollow outer tube 100 is a polyvinyl chloride (PVC) pipe. However, in other various embodiments, the hollow outer tube 100 may be formed of another suitable material, such as fiberglass, other types of plastics, wood, metal, or composite materials.

In various other embodiments, the channel of the at least one outer support member may have a U-shaped cross section 800 as shown in FIG. 8, a V-shaped cross section (not shown), a partial trapezoidal-shaped cross section 900 as shown in FIG. 9, a triangular-shaped cross section 600 as shown in FIG. 6, or a rectangular-shaped cross section 700 as shown in FIG. 7. The cross section is viewed in a plane that extends substantially perpendicularly to the longitudinal axis of the at least one outer support member. In another embodiment, as shown in FIG. 11, the at least one outer support member includes two or more support members 1100 that are axially spaced apart from each other along the longitudinal axis of the outer support members 1100. And, in yet another embodiment (not shown), the at least one outer support member may be the lower surface of the chamber 470 adjacent each sort bin 460.

Elongated Inner Member

In the embodiment shown in FIGS. 2, 3, 4, and 5, the elongated inner member 200 is substantially cylindrical and has an outer diameter 250 that is smaller than the inner diameter 130 of the channel 110 of the hollow outer tube 100. The length of the elongated inner member 200 is at least as long as the length of the hollow outer tube 100. In various other embodiments (not shown), the length of the elongated inner member 200 is substantially the same as the length of the channel of the at least one outer support member or is shorter than the length of the channel of the at least one outer support member.

According to one embodiment of the invention, the elongated inner member 200 is a PVC pipe. However, in other various embodiments, the elongated inner member 200 may be formed of another suitable material, such as fiberglass, other types of plastics, wood, metal, or composite materials.

In addition, in one embodiment, the elongated inner member 200 is hollow, and, in another embodiment, the elongated inner member 200 is solid.

FIG. 12 illustrates an embodiment in which the elongated inner member 200 is hollow and defines a hollow chamber 252. A rod 255 is bent into an arcuate shape and is slidably disposed within the hollow chamber 252 of the elongated inner member 200 such that the medial portion 256 of the rod 255 engages the inner surface of the hollow chamber 252 adjacent a medial portion 235 of the elongated inner member 200. The arcuate bend of the rod 255 urges the medial portion 235 of the elongated inner member 200 to bend slightly in a radially outward direction, which results in increased frictional contact between an outer surface 251 of the elongated inner member 200 and an inner surface of the hollow outer tube 100. In a particular embodiment, the ends of the rod 255 are prevented from movement in an axial direction by inserting plugs, such as the plugs 225 described below, onto the ends of the elongated inner member 200, and the plugs 225 engage the ends of the rod 255 should the ends of the rod move axially toward the plugs 225. The ends of the rods 255 may also be prevented from movement in the axial direction by engaging the inner surface of the elongated inner member 200. In a particular embodiment, the rods 255 are steel rods having a diameter of about ¼" and a length that is slightly shorter than the length of the elongated inner member 200. In various other embodiments, other suitable materials (e.g., brass, aluminum, fiberglass), diameters, and/or lengths (e.g., longer than or substantially the same length as the elongated inner member 200) may be used for the rod such that the rod is able to maintain its bend within the hollow chamber 252 of the elongated inner member 200 and cause the elongated inner member 200 to bend against the hollow outer tube 100.

In various other embodiments, the elongated inner member 200 may have a triangular-shaped cross section 650 as shown in FIG. 6 or a rectangular-shaped cross section 750 as shown in FIG. 7, wherein the cross section is in a plane that extends substantially perpendicularly through the longitudinal axis of the elongated inner member 200.

Plugs

As shown in FIG. 4, the elongated inner member 200 is moveably disposed within each of the hollow outer tubes 100 that are disposed in each chamber 470 of the sort station system 400. According to various embodiments, friction between the outer surface of the elongated inner member 200 and at least the lower inner surface of the hollow outer tube 100 prevents unintentional movement of the elongated inner member 200 relative to the hollow outer tube 100. To further prevent unintentional movement relative to the hollow outer tube 100, in one embodiment, a plug 225 is disposed on each end of each elongated inner member 200 (as shown in FIGS. 2, 3, and 4).

In one embodiment, each plug 225 has a distal end and an engagement end, and at least a portion of the distal end extends in an axially outward direction from the ends 220*a*, 220*b* of the elongated inner member 200. The distal end includes an outer surface that is radially spaced apart from the longitudinal axis and the outer surface of the elongated inner member 200, and the outer surface of the distal end of each plug 225 has a diameter that is greater than the diameter of the outer surface of the elongated inner member 200. The outer surface of each plug 225 is biased in a radially outward direction such that when an end of the elongated inner member 200 is positioned adjacent the channel 110 of the hollow outer tube 100, the outer surface of the plug 225 attached to the end is biased against the inner surface of the channel of the hollow outer tube 100. This arrangement helps further limit unintentional movement of the elongated inner member 200 according to one embodiment.

In one embodiment, the plugs 225 are formed from a rubber or other elastic material and are secured to each end 220*a*, 220*b* of the elongated inner member 200 adjacent the engagement ends of the plugs 225. For example, in one embodiment, at least a portion of the engagement end of each plug 225 has an outer diameter that is slightly less than the inner diameter of each end 220*a*, 220*b* of the hollow elongated inner member 200. To secure each plug 225 to each end 220*a*, 220*b*, the engagement end portion is inserted into each end 220*a*, 220*b* of the hollow elongated inner member 200, and the outer surface of the engagement end portion frictionally engages the inner surface of the hollow elongated inner member 200 to retain the plugs 225 within each end 220*a*, 220*b*.

In an alternative embodiment, the engagement end of each plug 225 may define an opening that receives the end 220*a*, 220*b* of the elongated inner member 200, and a wall of each plug adjacent the opening is biased against the outer surface of the elongated inner member 200 adjacent the end 220*a*, 220*b* to secure the plug 225 to the end 220*a*, 200*b*. In other various embodiments, the plug 225 may be screwed, nailed, adhered, or otherwise fastened to each end 220*a*, 220*b* of the elongated inner member 200. Furthermore, in various alternative embodiments, the plugs may be formed of another material, such as plastic, wood, metal, or a composite material.

Assembly and Operation of Communication System

To operate the communication system 300 according to various embodiments, the elongated inner member 200 is slidably moved in an axial direction. For example, in one embodiment, to indicate to the bagger that the sort bin 460 should be emptied (e.g., a first status), the loader pushes a first end of the elongated inner member 200 that is adjacent the sort bin 460 on the first side 440 of the sort station system 400 in an axial direction toward the second side 445 of the sort station system 400. That is, the loader pushes the first end such that a second end of the elongated inner member 200 is disposed outside of the channel 110 of the hollow outer tube 100 and the first end is disposed at least partially within the channel 110 of the hollow outer tube 100. To indicate that the sort bin 460 is ready for loading (e.g., a second status), the bagger pushes the second end of the elongated inner member 200 in the opposite axial direction toward the first side 440 of the sort station system 400 such that the first end of the elongated inner member 200 is disposed outside of the channel 110 of the hollow outer tube 100 and the second end is disposed at least partially within the channel 110 of the hollow outer tube 100.

In another embodiment, each end of the elongated inner member 200 may not be disposed within the channel 110 of the hollow outer tube 100 as described above. For example, in one embodiment, the first end of the elongated inner member 200 may be disposed a certain distance from one end of the hollow outer tube 100 to indicate the first status and another distance from the other end of the hollow outer tube 100 to indicate the second status. In yet another embodiment, the first end of the elongated inner member 200 may be pulled (instead of pushed) by the loader toward the first side 440 of the sort station system 400 to indicate the first status or the second end of the elongated inner member 200 may be pulled toward the second side 445 of the sort station system 400 to indicate the second status.

In various embodiments, at least a portion of the elongated inner member 200 is colored a light color (e.g., white or yellow), and at least a portion of the hollow outer tube 100 is colored a darker color (e.g., black or brown), or vice versa, to allow the sorter and bagger to distinguish more clearly the statuses indicated by the position of the ends of the hollow outer tube 100 relative to the ends of the elongated inner member 200. For example, in one embodiment, the elongated inner member 200 is white and the hollow outer tube 100 is dark grey (or black). In further embodiments, the outer surfaces of the plugs 225 are colored a darker color to visually distinguish the position of the elongated inner member 200 within the hollow outer tube 100 more clearly. For example, in one embodiment, the color of the plugs 225 are substantially the same color as the hollow outer tube 100.

In various other embodiments, the diameter of the outer surface of the plugs 225 is greater than the inner diameter 130 of the channel 110 of the hollow outer tube 100 to prevent movement of the plugs 225 through or into the channel 110. In such embodiments, the first status is indicated when the plug 225 at the first end of the elongated inner member 200 is disposed next to (or a certain distance away from) the first end of the channel 110 of the hollow outer tube 100, and the second status is indicated when the plug 225 at the second end of the elongated inner member 200 is disposed next to (or a certain distance away from) the second end of the channel 110.

FIG. 10 illustrates the steps of a method 1000 of operating the sort station communication system 400 shown in FIG. 4 according to one embodiment. Beginning at Step 1010, the loader loads the sort bin 460. Next, at step 1020, the loader determines if the sort bin should be unloaded. If the loader determines that the sort bin 460 should not be unloaded, the loader returns to Step 1010 and continues to load the sort bin 460. If the loader determines that the sort bin 460 should be unloaded, the loader communicates this determination as a first status to the bagger at Step 1030. In response to this communication, the bagger unloads the sort bin 460 at Step 1040. Next, at Step 1050, the bagger determines if the sort bin is ready for the loading of packages 480. If the bagger determines that the sort bin 460 is not ready for the loading of packages 480, the bagger returns to Step 1040 and continues to unload the sort bin 460. If the bagger determines that the sort bin 460 is ready for loading, the bagger communicates this determination as a second status to the loader at Step 1060. The communication of the first status and the second status may be carried out by moving the elongated inner member 200 in a first axial direction or a second axial direction, as described above in relation to FIGS. 1-4.

Many modifications and other embodiments of the invention will come to mind to one skilled in the art to which this invention pertains having the benefit of the teachings presented in the forgoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A sort station communication system comprising:

at least one outer support member defining a channel along a first longitudinal axis of said at least one outer support member, said channel having a first end opposite a second end and an inner width; and an elongated inner member extending along a second longitudinal axis and having a first end opposite a second end and an outer width, said outer width of said elongated inner member being smaller than said inner width of said at least one outer support member;

wherein:

said elongated inner member is slideably disposed within said channel of said at least one outer support member such that: (A) a first status is indicated by said first end of said elongated inner member being disposed at a first position proximate said first end of said channel, and (B) a second status is indicated by said second end of said elongated inner member being disposed at a second position proximate said second end of said channel; and said first position and said second position are spaced apart axially from each other.

2. The sort station communication system of claim 1 wherein said at least one outer support member consists of an elongated outer support member.

3. The sort station communication system of claim 2 wherein said elongated outer support member comprises a hollow tube.

4. The sort station communication system of claim 3 wherein said hollow tube defines a substantially circular cross-section in a plane substantially perpendicular to said first longitudinal axis.

5. The sort station communication system of claim 4 wherein:

said elongated inner member is substantially cylindrical and has a first outer diameter, said channel of said hollow tube has a second inner diameter, and said first outer diameter is smaller than said second inner diameter.

6. The sort station communication system of claim 5 wherein:

said elongated inner member is hollow and defines a hollow chamber extending along said second longitudinal axis, an elongated rod having an arcuate shape is slidably disposed within said hollow chamber of said elongated inner member such that a medial portion of said rod engages an inner surface of said hollow chamber adjacent a medial portion of said elongated inner member, and said medial portion of said rod is configured for urging said medial portion of said elongated inner member in a radially outward direction.

7. The sort station communication system of claim 2, wherein said channel has a substantially triangular cross-section in a plane substantially perpendicular to said first longitudinal axis.

8. The sort station communication system of claim 2, said channel has a substantially rectangular cross-section in a plane substantially perpendicular to said first longitudinal axis.

9. The sort station communication system of claim 1, wherein said channel has a substantially U-shaped cross-section in a plane substantially perpendicular to said first longitudinal axis.

10. The sort station communication system of claim 1, wherein said channel has a substantially V-shaped cross-section in a plane substantially perpendicular to said first longitudinal axis.

11. The sort station communication system of claim 1, wherein said at least one elongated inner member has a substantially triangular cross-section in a plane substantially perpendicular to said second longitudinal axis.

12. The sort station communication system of claim 1, wherein said at least one elongated inner member has a substantially rectangular cross-section in a plane substantially perpendicular to said second longitudinal axis.

13. The sort station communication system of claim 1 wherein said first end of said elongated inner member comprises a first plug, and said first plug has an outer surface radially spaced apart from said second longitudinal axis, said outer surface having a second width that is greater than said width of said elongated inner member, wherein said outer surface of said plug is biased in a radially outward direction.

14. The sort station communication system of claim 13 wherein said second end of said elongated inner member comprises a second plug, said second plug having an outer surface radially spaced apart from said second longitudinal axis, and said outer surface having a third width that is greater than said width of said elongated inner member, wherein said outer surface of said second plug is biased in a radially outward direction.

15. The sort station communication system of claim 1 wherein said channel has a first length and said elongated inner member has a second length, and said first length is shorter than said second length.

16. The sort station communication system of claim 1 wherein said channel has a first length and said elongated inner member has a second length, and said first length is substantially the same as said second length.

17. The sort station communication system of claim 1, wherein said elongated inner member is configured to be held in place relative to said end of said at least one outer support member by friction.

18. The sort station communication system of claim 1 wherein said first position is outside said channel and said second position is inside said channel.

19. The sort station communication system of claim 1 wherein said at least one outer support member comprises two or more outer support members, said two or more outer support members being spaced apart from each other along said first longitudinal axis.

20. The sort station communication system of claim 1 wherein said first and second longitudinal axes are coaxial.

21. The sort station communication system of claim 1 wherein at least a portion of the elongated inner member is colored a first color, and at least a portion of the at least one outer support member is colored a second color, the first color being lighter than the second color.

22. The sort station communication system of claim 21 wherein at least one of said first and second ends of said elongated inner member comprises a plug, and said plug is colored a third color, said third color being darker than said first color.

23. The sort station communication system of claim 22 wherein said third color is substantially similar to said second color.

24. A sort station system comprising:

a sort station comprising at least one sort bin extending from a first side of said sort station to a second side of said sort station, said first side being spaced apart from and opposite said second side;

at least one outer support member, said at least one outer support member defining a channel along a first longitudinal axis of said at least one outer support member, and said channel of said at least one outer support member having a first end opposite a second end and an inner width, said at least one outer support member being disposed adjacent said at least one sort bin of said sort station, and said first longitudinal axis of said at least one outer support member extending from said first side to said second side of said sort station; and an elongated inner member extending along a second longitudinal axis and having a first end opposite a second end and an outer width, said outer width of said elongated inner member being smaller than said inner width of said at least one outer support member, wherein:

said elongated inner member is slideably disposed within said channel of said at least one outer support member such that: (A) said first and said second longitudinal axes are coaxial, (B) a first status is indicated by said first end of said elongated inner member being disposed in a first position proximate said first end of said channel, and (C) a second status is indicated by said second end of said elongated inner member being disposed at a second position proximate said second end of said channel; and said first position and said second position are spaced apart axially from each other.

25. The sort station communication system of claim 24 wherein said at least one outer support member is disposed in an opening extending through said sort station adjacent said sort bin.

26. The sort station communication system of claim 24 wherein said at least one outer support member is an opening extending through said sort station from said first side to said second side, said opening being adjacent said sort bin.

27. The sort station communication system of claim 24 wherein said first longitudinal axis of said at least one outer support member and said second longitudinal axis of said elongated inner member have a slanted orientation relative to a substantially horizontal plane extending through said sort station from said first side to said second side.

28. The sort station communication system of claim 24, wherein said first longitudinal axis of said at least one outer support member and said second longitudinal axis of said elongated inner member are substantially parallel to a substantially horizontal plane extending through said sort station from said first side to said second side.

29. A method of indicating a first status and a second status, said method comprising the steps of:

providing at least one outer support member defining a channel along a first longitudinal axis of said at least one outer support member, and said channel having a first end opposite a second end and an inner width;

providing an elongated inner member extending along a second longitudinal axis and having a first end opposite a second end and an outer width, said outer width of said inner tube being smaller than said inner width of said at least one outer support member, wherein said elongated inner member is slideably disposed within said channel of said at least one outer support member;

slideably moving a first end of said elongated inner member in a first direction along said second longitudinal axis to indicate a first status, said first end of said elongated inner member being moved to a first position proximate said first end of said channel; and slideably moving a second end of said elongated inner member in a second direction along said second longitudinal axis to indicate a second status, said second end of said elongated inner member being moved to proximate said second end of said channel.

30. The method of claim 29 wherein said first direction is opposite said second direction.

31. The method of claim 29 wherein said first position and said second position are outside of said channel of said at least one outer support member.

32. The method of claim 29 wherein said first position and said second position are inside of said channel of said at least one support member.

33. The method of claim 29 further comprising the step of disposing said at least one outer support member and said elongated inner member adjacent a sort bin defined in a sort station, said sort bin extending from a first side of said sort station to a second side of said sort station, said first side of said sort station being spaced apart and opposite said second side of said sort station, and wherein said first and second longitudinal axes of said at least one outer support member and said elongated inner member extend between said first side and said second side of said sort station.

34. The method of claim 33 wherein said first and second longitudinal axes of said at least one outer support member and said elongated inner member have a slanted orientation relative to a substantially horizontal plane extending through said sort station from said first side of said sort station to said second side of said sort station.

* * * * *